United States Patent [19]

Whiteley et al.

[11] Patent Number: 4,944,348

[45] Date of Patent: Jul. 31, 1990

[54] ONE-TRIP WASHDOWN SYSTEM AND METHOD

[75] Inventors: Thomas G. Whiteley, Houston; Travis W. Cavender, Angelton, both of Tex.

[73] Assignee: Halliburton Company, Duncan, Okla.

[21] Appl. No.: 441,786

[22] Filed: Nov. 27, 1989

[51] Int. Cl.[5] ..... E21B 37/00; E21B 43/04

[52] U.S. Cl. ..... 166/278; 166/51; 166/114; 166/377

[58] Field of Search ..... 166/51, 278, 312, 114, 166/205, 318, 386, 387, 373, 126, 128, 131, 143, 149, 150

[56] References Cited

U.S. PATENT DOCUMENTS

| | | | |
|---|---|---|---|
| 2,755,862 | 7/1956 | Abendroth et al. | 166/51 |
| 3,710,862 | 1/1973 | Young et al. | 166/51 X |
| 3,997,006 | 12/1976 | Wetzel | 166/114 |
| 4,424,864 | 1/1984 | Logan | 166/278 |
| 4,570,714 | 2/1986 | Turner et al. | 166/278 |
| 4,638,860 | 1/1987 | Magee, Jr. et al. | 166/114 |
| 4,671,361 | 6/1987 | Bolin | 166/377 |
| 4,856,590 | 8/1989 | Caillier | 166/51 |

OTHER PUBLICATIONS

Exhibit A–Drawing of Modified Crossover Setting Tool, Date of publication unknown.

Exhibit B–Drawing of Washdown Shoe, Date of publication unknown.

Exhibit C–Drawing of Prior Art Locater and Latching Seal Assembly, Date of publication unknown.

Exhibit D–Drawing of Crossover Setting Tool, Date of publication not provided.

*Primary Examiner*—Stephen J. Novosad

*Attorney, Agent, or Firm*—James R. Duzan; L. Wayne Beavers

[57] ABSTRACT

Gravel packing systems are disclosed which permit sand fill to be reverse circulated out of a well without tripping the gravel packing system itself out of the well. The gravel packing system can be utilized with a sump packer. An outer seal assembly is constructed to be received in a bore of the sump packer. The seal assembly has a seal assembly bore therethrough which receives a lower end of a wash pipe. A wash pipe extension is partially received in the lower end of the seal assembly bore and extends downward below the seal assembly. The wash pipe extension is communicated with the wash pipe. A releasable retaining structure is operably associated with the wash pipe and the wash pipe extension and initially retains the wash pipe in the seal assembly bore. Subsequently, the wash pipe extension is released upon upward movement of the wash pipe. Methods of gravel packing are also disclosed.

22 Claims, 6 Drawing Sheets

ONE-TRIP WASHDOWN SYSTEM AND METHOD

BACKGROUND OF THE INVENTION

1. Field Of The Invention

The present invention is directed generally to systems for gravel packing of wells, and more particularly to systems which permit reverse washing of fill encountered as the gravel packing system is run into the well, without tripping the gravel packing system out of the well.

2. Description Of The Prior Art

One typical gravel packing system utilized to perform a circulating gravel pack includes a packer and a crossover setting tool associated with the packer for setting the packer and for controlling the flow of fluids during gravel packing operations. When running such a gravel packing system into a well, one sometimes will encounter sand fill which has infiltrated into the well and blocks the passage down through the well. When this occurs, it is necessary to trip the gravel packing system out of the well, and run a clean out string into the well which is capable of reverse circulating the fill out of the well. Then the gravel packing system must once again be run into the well to perform the gravel packing operation.

One example of such a gravel packing system is that shown in U. S. Pat. No. 4,570,714 to Turner et al. The Turner et al. system utilizes a retrievable packer which is removed from the well with the setting tool after the gravel packing operation is completed.

The assignee of the present invention has also utilized a modified form of the Turner et al. apparatus having a crossover setting tool which initially has an open bore therethrough, and having a washdown shoe at the lower end of the string which receives the wash pipe and which initially permits reverse circulation up through the wash pipe and the work string as the tool is run into the well. If sand fill is encountered as the tool is run into the well, the sand fill can be reversed out without having to pull the work string and gravel packing system. This modified system utilizing a washdown shoe is not capable of washing sand fill from a sump packer.

In wells utilizing a sump packer below the zone to be gravel packed, it is necessary for the gravel packing system to have its lower end sealingly engaged with a bore of the sump packer prior to performing the gravel packing operation. With prior art systems, if sand fill is encountered directly on top of the sump packer, it has been necessary to trip the gravel packing system and its work string out of the well, and run a tapered work string into the well to reverse circulate the sand fill away from the sump packer, then the tapered work string must be tripped out and the gravel pack system again run into the well.

None of the prior art gravel packing systems have been capable of washing sand fill out of a sump packer without first tripping the work string and gravel packing system out of the well and running a special string into the well for purposes of washing the sand fill.

SUMMARY OF THE INVENTION

The present invention provides a gravel packing system which permits reverse washing of sand fill without tripping the gravel packing system out of the well. This saves substantial rig time and expense during the gravel packing operation. This system is improved in several respects as compared to the modified Turner et al. system mentioned above which has previously been used by the assignee of the present invention.

The present invention is particularly adapted for use in gravel packing a zone of a well located above a sump packer. The gravel packing system includes a wash pipe extension assembly which is suspended below the gravel packing screen. The wash pipe extension assembly includes an outer seal assembly constructed to be received in the bore of the sump packer. The seal assembly has a seal assembly bore defined therethrough having an upper end and a lower end. The wash pipe of the setting tool extends down into the upper end of the seal assembly bore.

A wash pipe extension is partially received in the lower end of the seal assembly bore and extends downward below the seal assembly. The wash pipe extension is communicated with the wash pipe.

A releasable retaining means is operably associated with the wash pipe and the wash pipe extension for initially retaining the wash pipe extension in the seal assembly bore and for subsequently releasing the wash pipe extension in response to upward movement of the wash pipe relative to the seal assembly.

This system permits sand fill to be washed from directly above and within the bore of a sump packer by use of the wash pipe extension as a stinger which extends into the sump packer bore while reverse circulating the sand fill out of that bore.

Also, the gravel packing system of the present invention provides a gravel packing system utilizing a permanent production packer, which system also permits reverse circulating of sand fill encountered during the running in of the system into a well.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1A:
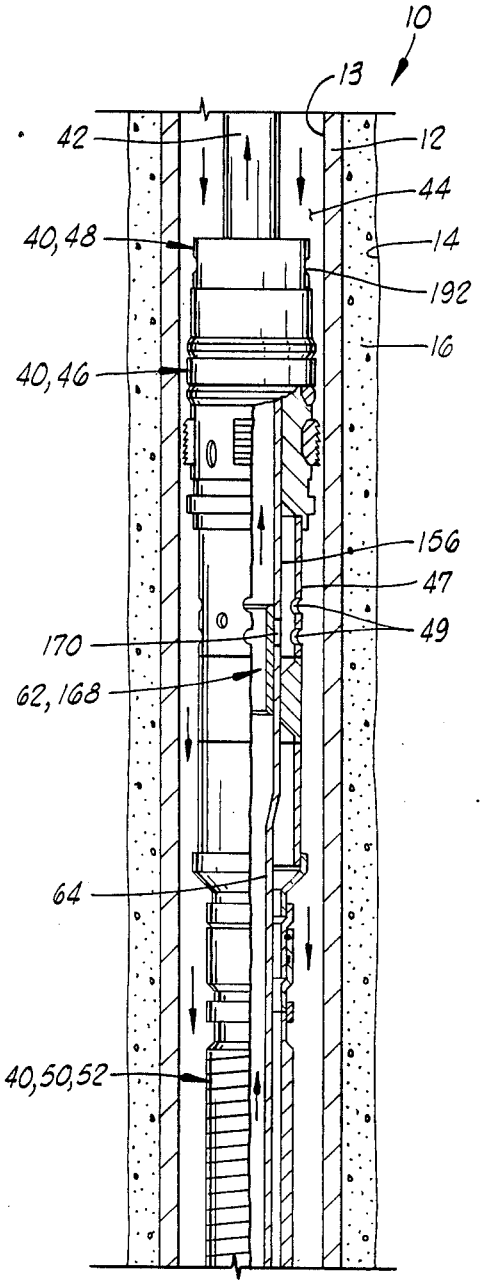
FIGS. 1A–1B comprise a sectioned elevation schematic view of the gravel packing system of the present invention being run into a well, and having just encountered sand fill above a sump packer. Fluid flow as represented by the arrows is in a reverse circulation mode so that the sand fill is being reverse circulated up through the tubing string.
Figure 1B:
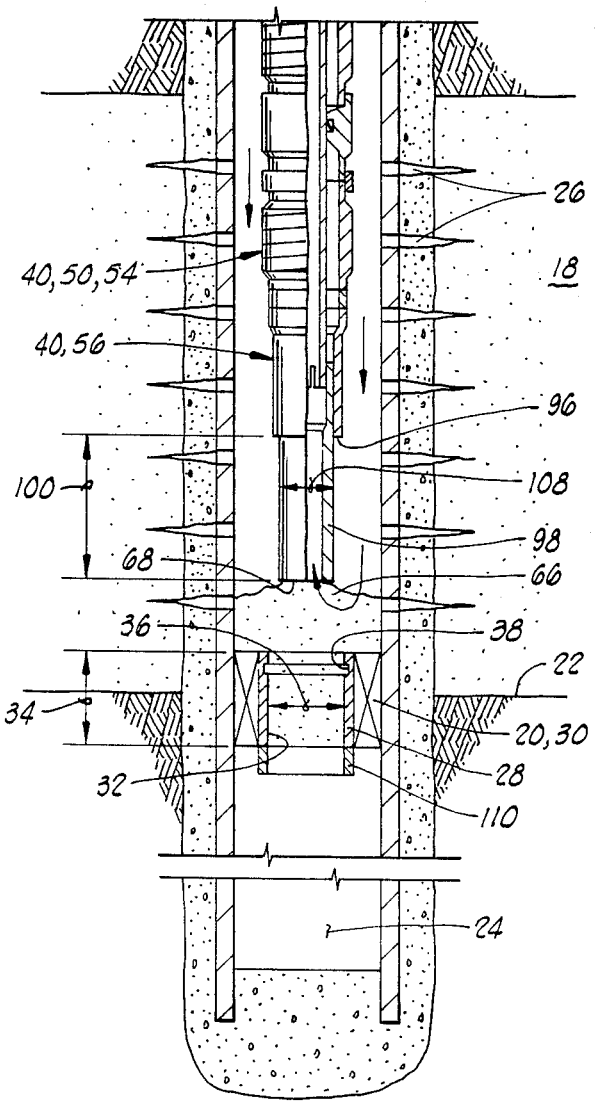

Referring now to the drawings, and particularly to FIGS. 1A–1B, a well is shown and generally designated by the numeral 10. The well 10 includes a casing 12 which is set within a bore hole 14 and cemented in place by cement 16. A bore 13 of casing 12 can generally be referred to as a casing bore 13 or well bore 13. The well 10 intersects a subsurface formation 18 from which it is desired to produce oil or gas. A sump packer 20 has previously been set within the casing 12 adjacent a lower boundary 22 of formation 18. A sump 24 is defined in the well 10 below the sump packer 20.

It will be appreciated by those skilled in the art that the sump packer 20 may also be a sump packer/production packer associated with another producing subsurface formation (not illustrated) located below the sump packer 20. For purposes of the present disclosure, the packer 20 will simply be referred to as a sump packer 20, and it will be understood that there may, of course, be other production zones below the packer 20.

Prior to running the gravel packing system described herein into the well 10, the well has been perforated to form perforations such as 26 extending through the casing 12 and cement 16 into the subsurface formation 18 to permit fluids to flow therefrom into the well 10.

The sump packer 20 includes a sump packer mandrel 28 and a sealing element 30 disposed about the mandrel 28 for sealing against the casing 12. A sump packer bore 32 is defined through the mandrel 28. The bore 32 has a sump packer bore length 34, and a sump packer bore inside diameter 36. An annular locking groove 38 is defined in the sump packer bore 32 for receiving a latch of a seal assembly as further described below.

A gravel packing assembly is shown and generally designated by the numeral 40. The gravel packing assembly 40 is constructed to be run on a tubing string 42 into the well 10. A well annulus 44 is defined between the well bore 13 on the outside and the tubing string 42 and gravel packing assembly 40 on the inside.

The gravel packing assembly 40 generally includes an upper packer means 46, a gravel packer extension 47, a crossover setting tool 48, a screen assembly 50 having a primary screen 52 and a telltale screen 54, and a wash pipe extension assembly 56 suspended from the screen assembly 50.

Figure 3A:
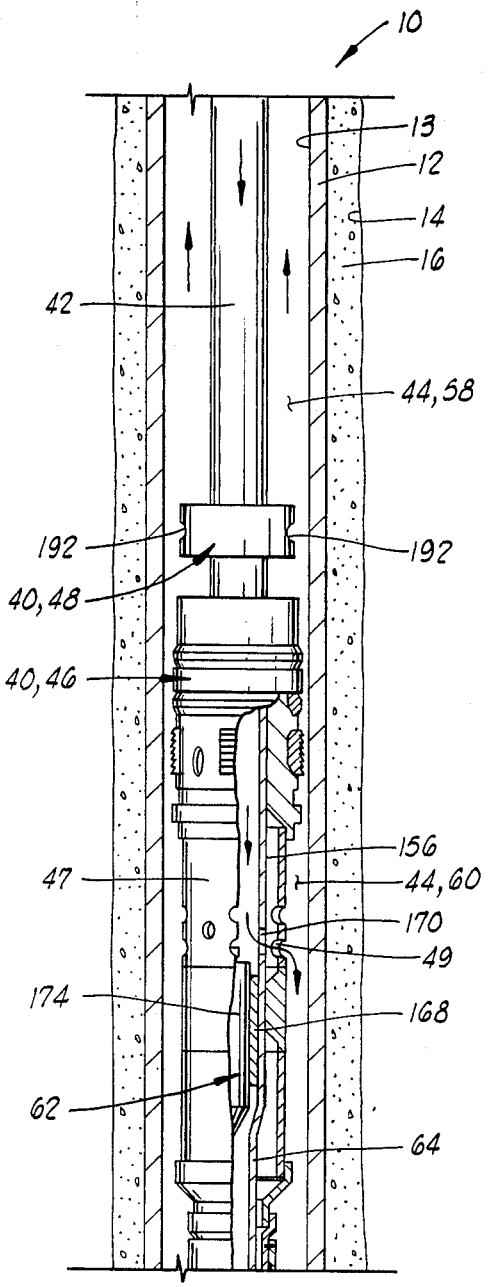
FIGS. 3A–3B comprise another view similar to FIGS. 1A–1B, after the permanent production packer has been set, and the wash pipe has been raised to a position permitting the circulating gravel pack operation to be performed. Fluid flow as represented by the arrows shows sand slurry being pumped down the work string, crossing over into the lower annulus to pack sand around the screens, with clean return fluid flowing through the screens and up the wash pipe, then crossing over into the upper annulus for return to the surface.

The upper packer means 46 is a means for sealing between the tubing string 42 and the well bore 13 to divide the well annulus 44 into an upper well annulus 58 and a lower well annulus 60 above and below the upper packer means 46. In FIG. 3A, the upper packer means 46 is shown in its set position and the upper well annulus 58 and lower well annulus 60 are indicated.

The upper packer means 46 is a hydraulically set permanent production packer constructed to be left in place in the well 10 with the screen assembly 50 after the lower well annulus 60 is gravel packed. The upper packer means 46 may, for example, be an Otis Versa-Trieve TM gravel packer as manufactured by Otis Engineering Corporation.

The gravel packer extension 47 extends down from packer means 46 and includes gravel packing ports 49.

The crossover setting tool 48 is operably associated with the upper packer means 46 for setting the upper packer in a well known manner. The crossover setting tool 48 includes crossover valve means 62 for permitting reversing out of sand fill up through the tubing string 42 during running in of the tubing string 42 and gravel packing assembly 40 into a well. The operation of crossover valve means 62 is further described below with reference to FIGS. 7–9.

The crossover setting tool 48 also includes a downward extending wash pipe 64 which is initially communicated with the tubing string 42 through the crossover valve means 62.

The screen assembly 50 is located below said upper packer means 46 and gravel packer extension 47 and has the wash pipe 64 extending downwardly therethrough in a concentric manner.

The wash pipe extension assembly 56, which may also generally be referred to as a wash pipe extension means 56, provides a means for permitting reverse circulation of sand fill out of the sump packer bore 32 up through the wash pipe 64 and tubing string 42.

In FIG. 1B, a pile of sand fill is schematically illustrated and designated by the numeral 66 on top of the sump packer 20 and inside sump packer bore 32. To wash the sand fill 66 out of the well 12, fluid is pumped down the well annulus 44 as indicated by arrows. The fluid flow turns upward into a lower end 68 of the wash pipe extension assembly 56. The fluid, carrying entrained sand from sand fill 66, then flows up the wash pipe 64 and up the tubing string 42 as indicated by the arrows, to the surface.

Figure 4:
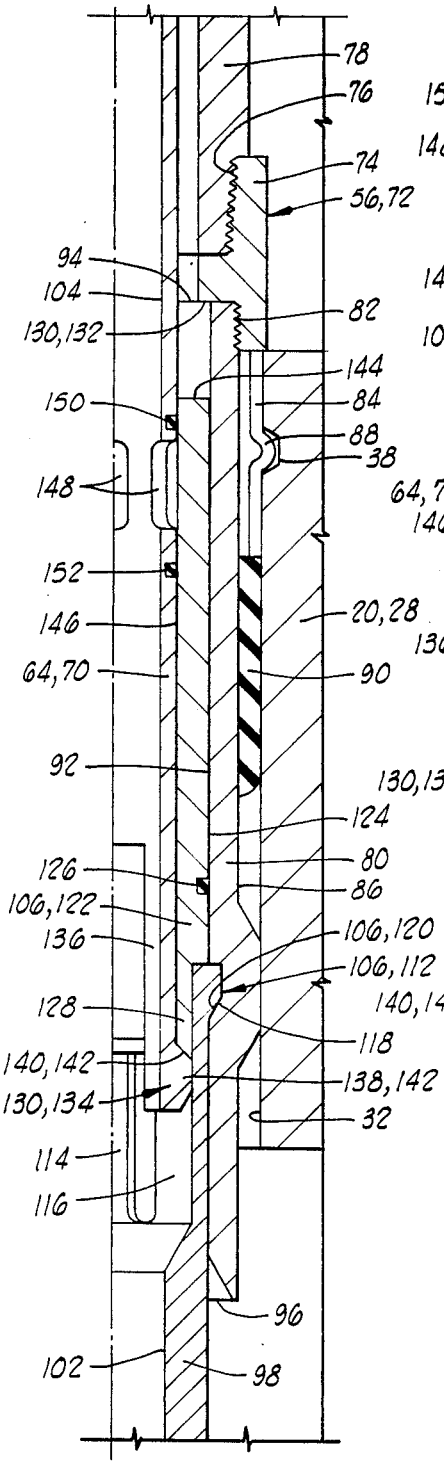
FIG. 4 is a right side only elevation half-section view of the wash pipe extension assembly showing the same sealingly received in the sump packer bore in a position corresponding to that of FIG. 2B, after the sand fill has already been washed from the sump packer, and prior to performing the gravel packing operation.

The wash pipe extension assembly 56 is best shown in FIG. 4 in combination with a lower portion 70 of wash pipe 64. Wash pipe extension assembly 56 includes an outer seal assembly 72 constructed to be sealingly received in the sump packer bore 32. The outer seal assembly 72 includes an upper box end 74 threadedly connected at 76 to a pin end 78 extending downward from telltale screen 54. Outer seal assembly 72 further includes a cylindrical body 80 threadedly connected to box end 74 at thread 82. A plurality of flexible locater arms 84 extend downward from box end 74 about an outer surface 86 of body 80. The locater arms 84 each have an outward extending ridge 88 which snaps into place in locking groove 38 of sump packer mandrel 28. An annular sealing member 90 is disposed about outer surface 86 of body 80 and is sealingly engaged with the sump packer bore 32.

Figure 2A:
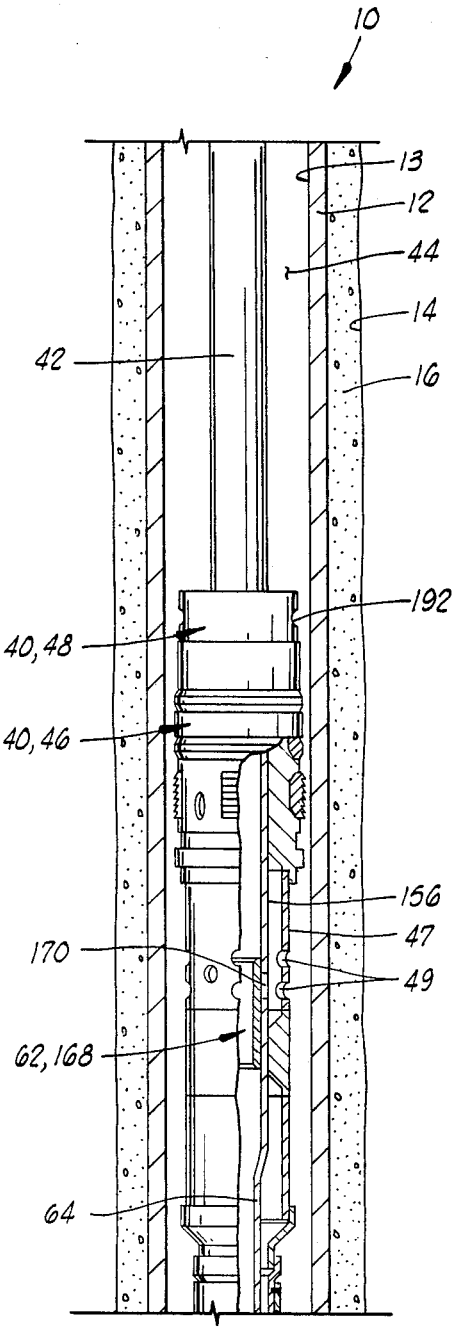
FIGS. 2A–2B comprise a view similar to FIGS. 1A–1B, after the sand fill has been reverse circulated from the sump packer, and the gravel packing assembly has been lowered into sealing engagement with the bore of the sump packer.
Figure 2B:
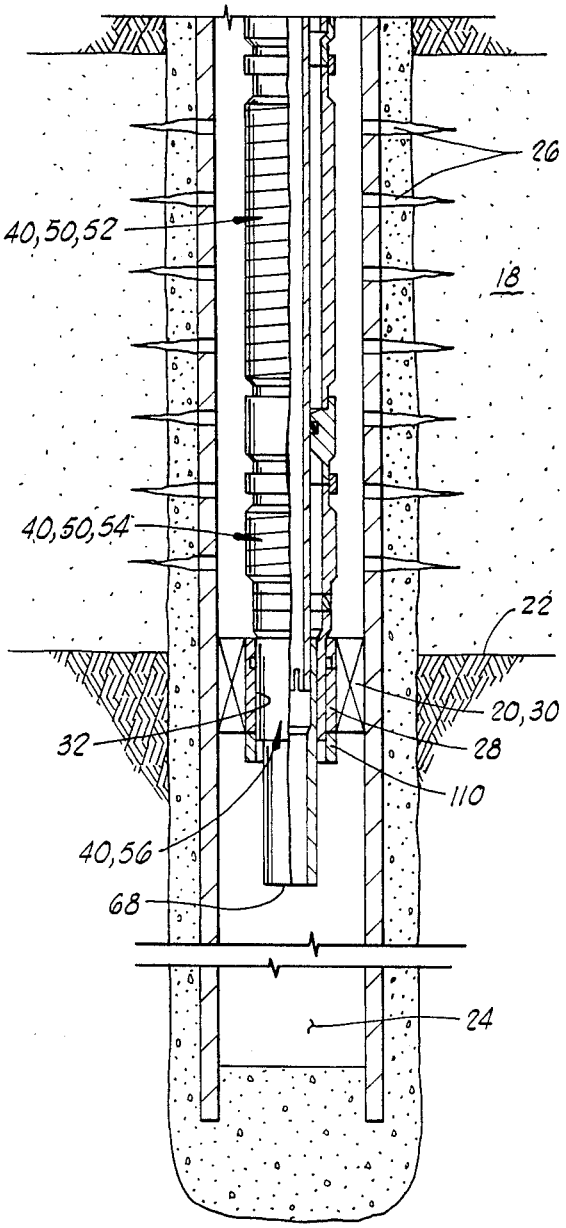

In FIG. 4, the wash pipe extension means 56 is shown sealingly latched in place within the sump packer bore 32 as it is in FIG. 2B, after the sand fill 66 has been washed away from the sump packer 20.

The outer seal assembly 72 has a seal assembly bore 92 extending therethrough having an upper end 94 and a lower end 96. The lower portion 70 of wash pipe 64 extends down into the upper end 94 of seal assembly bore 92.

A wash pipe extension 98 is partially received in the lower end 96 of seal assembly bore 92 and extends downward a distance 100 (see FIG. 1B) below the lower end 96 of seal assembly 72. The wash pipe extension 98 has an inner bore 102 which is communicated with an inner bore 104 of wash pipe 64.

Figure 3B:
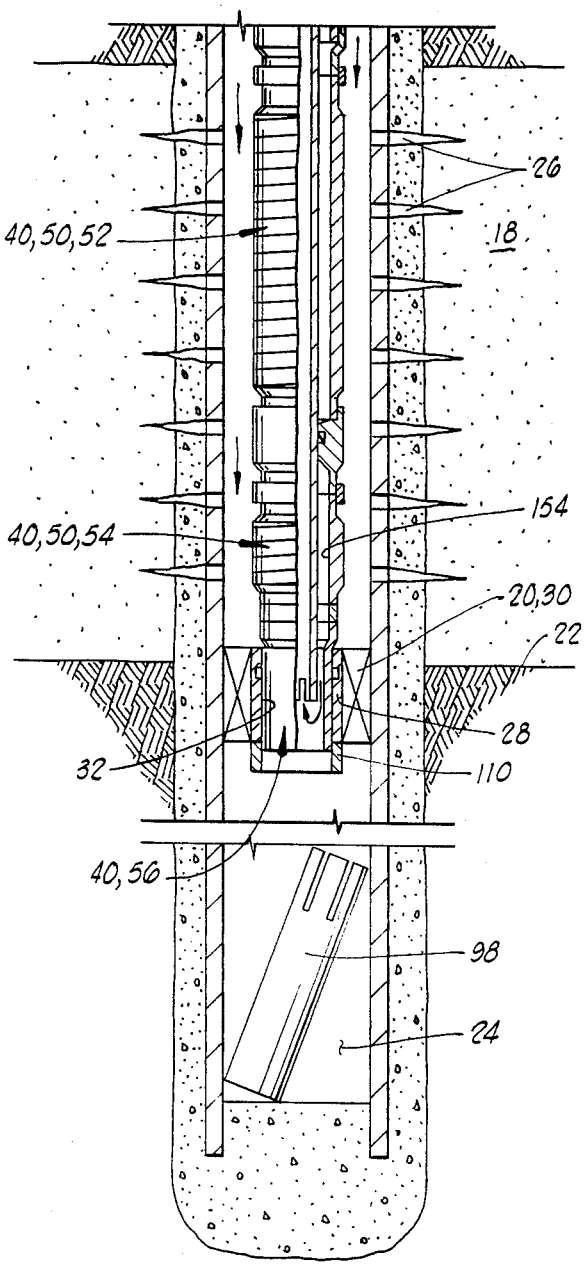
Figure 5:
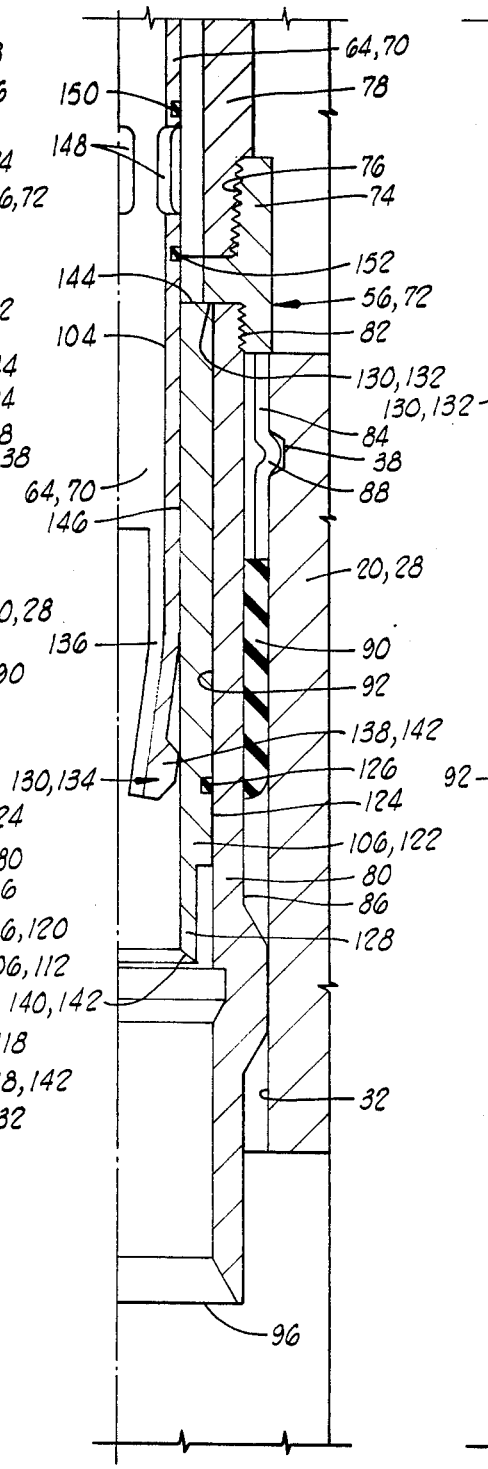
FIG. 5 is a view similar to FIG. 4 wherein the wash pipe has been moved upward relative to the sump packer to a position permitting return flow of clean fluid up through the wash pipe corresponding to the position of FIG. 3B. The wash pipe extension has been released from the seal assembly bore and has dropped out of the seal assembly and sump packer as schematically represented in FIG. 3B wherein the wash pipe extension is shown laying in the sump of the well.

A releasable retaining means, generally designated by the numeral 106, is operably associated with the wash pipe 64 and the wash pipe extension 98 for initially retaining the wash pipe extension 98 in place in the seal assembly bore 92 as illustrated in FIG. 4, and for subsequently releasing the wash pipe extension 98 in response to upward movement of the wash pipe 64 relative to the seal assembly 72 as shown in FIG. 5. This allows the wash pipe extension 98 to drop out of the seal assembly bore 92 and fall down into the sump 24 as schematically illustrated in FIG. 3B.

The distance 100 by which the wash pipe extension 98 extends below the seal assembly 72 is greater than the length 34 of the sump packer bore 32. Also, the wash pipe extension 98 has an outside diameter 108 (see FIG. 1B) substantially less than the diameter 36 of sump packer bore 32. This permits reversing out of the sand fill 66 from the sump packer bore 32 because it permits fluid to flow down through the well annulus 44 and then downward through an annular space between the outside diameter 108 of wash pipe extension 98 and the inside diameter 36 of sump packer bore 32 to wash the sand fill 66 out of sump packer bore 32 as the wash pipe extension 98 slowly moves downward into the sump packer bore 32. Since the wash pipe extension 98 extends downward by a length 100 greater than the length 34 of sump packer bore 32, this relatively long, relatively small diameter wash pipe extension 98 can wash out sand fill 66 from the entire length of sump packer bore 32.

For example, if the sump packer bore diameter 36 is 3.25 inches, the outside diameter 108 of wash pipe extension 98 should be about 2.3 inches.

As will be understood by those skilled in the art, the sump packer 20 will often have a nipple 110 connected to the lower end of sump packer mandrel 28 for receiving a plug (not shown). The wash pipe extension 98 should have a length sufficient also to wash out the nipple 110. If there is a plug located within the nipple 110, the same can be pushed out of the nipple 110 by exerting downward force thereon with the wash pipe extension 98 simply by setting down weight on the working string 42.

The releasable retaining means 106 includes a radially inwardly biased first spring collet 112 defined on the upper end of the wash pipe extension 98. The first spring collet 112 includes a plurality of spring fingers such as 114 and 116. Each of the spring fingers has a radially outward extending shoulder 118 defined thereon.

The releasable retaining means 106 also includes an upwardly facing annular latching surface or shoulder 120 defined on the seal assembly bore 92. Releasable retaining means 106 further includes a support means 122 which can also be referred to as a support sleeve 122, for initially retaining the shoulders 118 of the first spring collet 112 in engagement with the annular latching surface 120 of seal assembly bore 92.

The support sleeve 122 has an outer cylindrical surface 124 which is closely and slidably received within the seal assembly bore 92 with a sliding 0-ring seal 126 being provided therebetween. The support sleeve 122 has a reduced outside diameter lower sleeve portion or skirt 128 which is initially concentrically disposed within the upper end of first spring collet 112 to prevent the spring fingers such as 114 and 116 from springing inward. This holds the shoulders 118 in engagement with the latching surface 120 so as to initially hold the wash pipe extension 98 in place within the outer seal assembly 72.

The gravel packing assembly 40 further includes a second release means 130 operably associated with the wash pipe 64 and with the outer seal assembly 72 for releasing the support sleeve 122 from engagement with the wash pipe 64 after the wash pipe extension 98 is released from the seal assembly 72 and for permitting the support sleeve 122 to then also drop out of the seal assembly bore 92.

The second release means 130 includes an annular downward facing surface 132, which may also be referred to as a limit means 132, defined in the seal assembly bore 92 above the support sleeve 122, for limiting upward movement of support sleeve 122 within the seal assembly bore 92.

The second release means 130 also includes a second spring collet 134 defined on the lower end portion 70 of wash pipe 64. The second spring collet 134 includes a plurality of downward extending collet fingers 136 having enlarged heads 138 thereon which initially latch under a tapered lower end surface 140 of support sleeve 122.

The enlarged heads 138 and the lower end 140 of support sleeve 122 also can be described as providing an interconnection means 142 between the support sleeve 122 and the wash pipe 64 for moving the support sleeve 122 upward with the wash pipe 64 when the wash pipe 64 is moved upward relative to the outer seal assembly 72.

When the wash pipe extension assembly 56 is first stung into sealing latched engagement with the sump packer bore 32, the various components are in the position illustrated in FIG. 4.

Subsequent upward movement of the wash pipe 64 relative to the outer seal assembly 72 and sump packer 20 first pulls the support sleeve 122 upward until an upper end 144 thereof abuts the limit means 132, at which time the fingers 136 of second spring collet 134 cam inward so that the second spring collet 134 collapses and begins to pull upward through an inner bore 146 of the support sleeve 122. Once the enlarged heads 138 move upward past the upper extremity of first spring collet 112, the wash pipe extension 98 is released. The spring fingers such as 114 and 116 of first spring collet 112 spring inward moving the shoulders 118 out of engagement with the annular latching surface 120, and the wash pipe extension 98 drops out of the seal assembly bore 92 leaving the other components in the position generally illustrated in FIG. 5.

The lower end portion 70 of wash pipe 64 has a plurality of lateral ports 148 disposed therethrough. Upper and lower O-ring seals 150 and 152, respectively, are located in annular grooves above and below the ports 148 in the wash pipe 64. When the wash pipe 64 is in its initial position of FIG. 4, the O-rings 150 and 152 seal against the bore 146 of support sleeve 122 for initially preventing flow of fluids through the lateral ports 148 until such time as the wash pipe 64 is moved upward as shown in FIG. 5.

When the wash pipe 64 is moved upward to the position of FIG. 5, the ports 148 are communicated with an interior 154 (see FIG. 3B) of telltale screen 54. The position of the wash pipe 64 shown in FIG. 5 corresponds to its position during the circulating gravel pack operation schematically illustrated in FIG. 3A–3B. The overall operation of the gravel pack assembly 40 is further described below.

It is noted that in the schematic illustration of FIG. 3B, the ports 148 have not been illustrated, and instead the entry of return fluids is schematically shown as entering the lower end of the wash pipe 64. This is done simply for ease of illustration, and it will be understood that the preferred embodiment is that shown in detail in FIG. 5.

Figure 6:
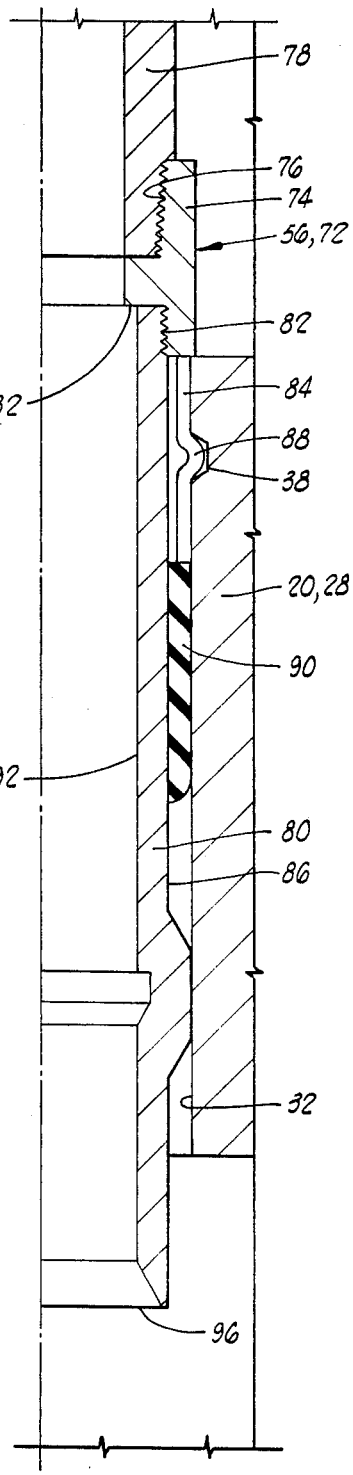
FIG. 6 is a view similar to FIGS. 4 and 5, after the gravel packing operation has been completed and the crossover setting tool with its wash pipe have been completely pulled out of engagement with the wash pipe extension assembly, thus permitting the support sleeve of the wash pipe extension assembly to also drop out of the sump packer.

After the gravel packing operation is completed, the crossover setting tool 48 and its wash pipe 64 are pulled upward completely out of engagement with the remainder of the gravel pack assembly 40 thus permitting the support sleeve 122 to drop out of the seal assembly bore 92 leaving the outer seal assembly 72 fully open as illustrated in FIG. 6. A fully open sump packer bore is desirable for several reasons. If there are lower production zones below sump packer 20 it may be necessary to run tools down through the sump packer 20. Also, it is desirable to have an open bore so that any solid particulate materials produced from the well will not collect on top of the sump packer.

Figure 7:
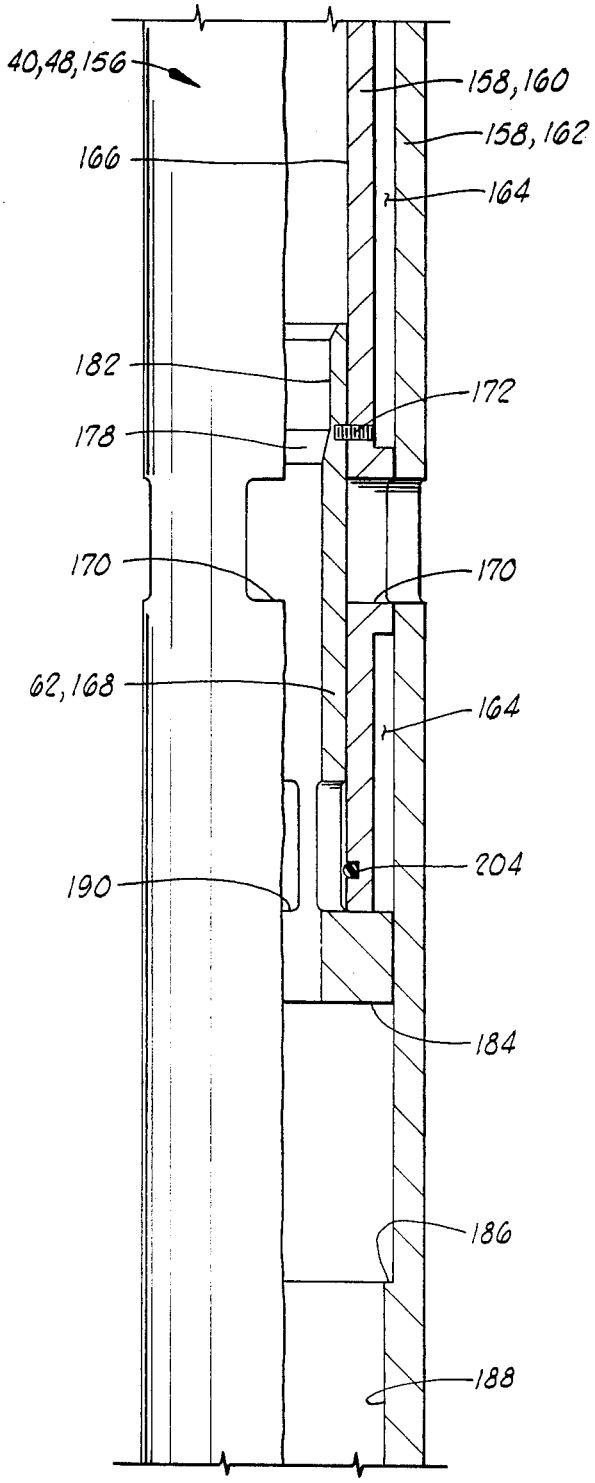
FIG. 7 comprises an elevation right side only sectioned view of the portion of the crossover setting tool adjacent the gravel packing ports. A crossover valve means is illustrated which controls the flow of fluid through the crossover setting tool. The crossover valve means is shown in its initial position in FIG. 7, corresponding to FIG. 1A, wherein flow is permitted up through the wash tube and tubing string and no crossover of fluid is permitted.
Figure 8:
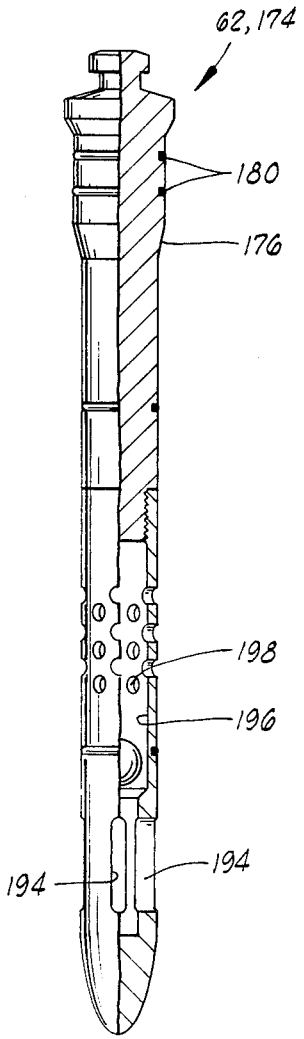
FIG. 8 is an elevation right side only sectioned view of a dart which is a portion of the crossover valve means and which is constructed to be received in the sleeve illustrated in FIG. 7 to subsequently block upward flow through the wash pipe and to open crossover ports to permit the gravel packing operation to be performed.
Figure 9:
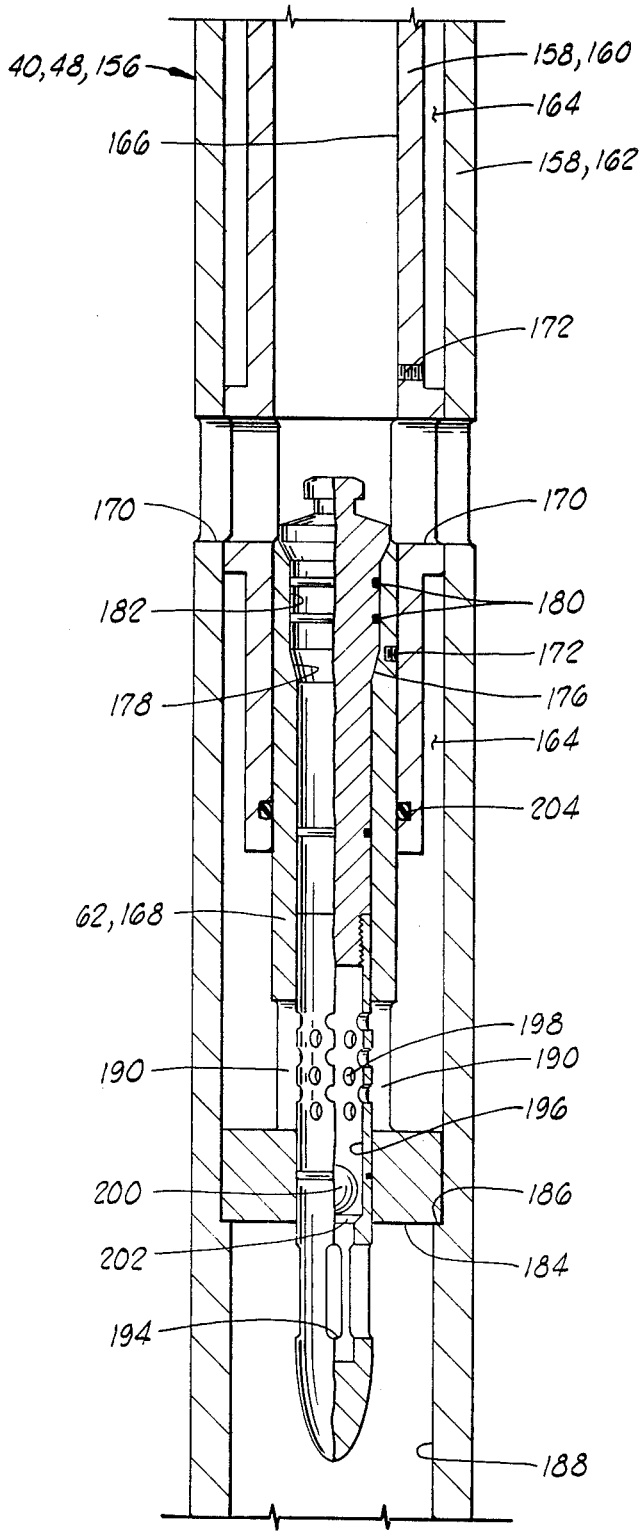
FIG. 9 illustrates the dart of FIG. 8 having been received in the sleeve of the setting tool of FIG. 7, with the sleeve having moved down to a position corresponding to that during which the gravel packing operation is performed. In the position of FIG. 9, slurry flows downward through the work string, then into the lower well annulus, then back up through the wash tube and over to the upper well annulus corresponding to the flow previously described with regard to FIG. 3A–3B.

Turning now to FIGS. 7–9, the crossover valve means 62 will be further described.

As previously mentioned, the crossover valve means 62 provides a means for permitting reverse circulation of fluid up through the tubing string 42 while running the tubing string 42 into the well, as schematically illustrated in FIGS. 1A–1B. The crossover valve means 62 also provides a means for subsequently isolating the wash pipe 64 from the tubing string 42 and for communicating the wash pipe 64 with the upper well annulus 58 and for communicating the tubing string 42 with the lower well annulus 60 to permit gravel packing of the lower well annulus 60 with the flow paths being as schematically illustrated in FIGS. 3A–3B.

FIG. 7 is an enlarged detailed view of a lower portion 156 of the crossover setting tool 48 which extends down through the upper packer means 46 and the gravel packer extension 47. It will be understood that in FIG. 7, the surrounding structure of the upper packer means 46, the gravel packer extension 47 and the well 10 have not been shown in order to simplify the illustration.

The lower portion 156 of crossover setting tool 48 includes a crossover body 158 having inner and outer concentric walls 160 and 162 defining an annular flow space 164 therebetween.

The inner concentric wall 160 has an inner bore 166 within which is received a sliding sleeve 168 which is a portion of the crossover valve means 62.

A plurality of radially extending lower crossover ports 170 extend radially outward from and communicate with the bore 166 of inner wall 160. Crossover ports 170 communicate with gravel packing ports 49 as seen in FIG. 3A.

The sleeve 168 is initially pinned in place by shear pins 172 in a position closing the lower crossover ports 170. As is further described below, the sleeve 168 will subsequently be moved downward uncovering the lower crossover ports 170 so as to provide fluid communication between the tubing string 42 and the lower well annulus 60. The ports 170 are referred to as lower crossover ports because they are associated with the lower well annulus 60.

To move the crossover valve means 62, and particularly the sleeve 168 thereof, from its initial reverse circulating position illustrated in FIG. 7 to a position as shown in FIG. 9 which will permit gravel packing, a dart 174 shown in FIG. 8 is dropped or pumped down the tubing string 42 into engagement with the sleeve 168. A tapered shoulder 176 of dart 174 seats in a tapered annular seat 178 of sleeve 168.

A pair of O-ring seals 180 seal between the dart 174 and an enlarged diameter upper bore 182 of sleeve 168.

Once the dart 174 is in seating engagement with the sleeve 168, pressure in the tubing string 42 is increased to set the hydraulically set upper packer 46. Then pressure is further increased until the shear pins 172 shear, thus allowing the dart 174 and sleeve 168 to move downward to the position of FIG. 9 where a lower end 184 of sleeve 168 abuts an upward facing annular shoulder 186 of outer wall 162.

A lower bore 188 of outer wall 164 is communicated with the bore 104 of wash pipe 64.

The sleeve 168 includes a plurality of upper crossover ports 190 which provide a means for communicating the wash pipe 64 with the upper well annulus 58. When the sleeve 168 is moved downward to the position of FIG. 9, the upper crossover ports 190 are communicated with the annular flow space 164 which communicates with other passages extending upward through the crossover setting tool 48 terminating in an upper crossover outlet 192 schematically shown in FIG. 3A thus communicating the wash pipe 64 with the upper well annulus 58.

The dart 174 has a hollow lower portion which has inlets 194, a bore 196 and outlets 198 which communicate the lower bore 188 and wash pipe 64 with the upper crossover ports 190 in the position of FIG. 9. A ball check valve 200 is disposed in the bore 196 and seats on a conical annular seat 202 to prevent downward flow therethrough when the dart 174 is positioned as shown in FIG. 9.

An O-ring seal 204 seals between the bore 166 of inner wall 158 and the sleeve 122 above the upper crossover ports 190.

MANNER OF OPERATION

The methods of gravel packing wells with the apparatus just described are generally as follows.

A gravel packing assembly like the assembly 40 is supported from the tubing string 42, and then the tubing string 42 and gravel packing assembly 40 are run into the well 10 until a sand fill such as sand fill 66 is encountered. It will be appreciated that sand fill may be encountered at various locations throughout the well in addition to immediately adjacent and within the sump packer 20.

Upon encountering sand fill, the sand fill is reverse washed from the well 10 by pumping fluid down through the well annulus 44 and up through the wash pipe 64 and tubing string 42 as is schematically illustrated in FIGS. 1A–B. Once all of the sand fill is eliminated, two tubing volumes of fluid are reverse circulated to make certain that the sand is removed from the system.

During or after the sand fill is washed out, the tubing string 42 is run further into the well 10 until the gravel packing assembly 40 is located at a desired preselected location. In the embodiment disclosed, the desired preselected location is that in which the wash pipe extension assembly 56 is stung into place within the sump packer 20 as schematically illustrated in FIGS. 2A–2B.

The dart 174 is dropped to set the packer 46 and to operate the sleeve 168 moving it to its lowermost position as shown in FIG. 9, thus communicating the tubing string 42 with the lower well annulus 60 and communicating the wash pipe 64 with the upper well annulus 58.

The wash pipe 64 is moved upward relative to the screen assembly 50 with the screen assembly 50 and the permanent production packer 46 fixed in place within the well 10, until the wash pipe 64 is communicated with the interior of the screen assembly 50, as is schematically illustrated in FIGS. 3A–3B and as is illustrated in FIG. 5.

Then the lower well annulus 60 is gravel packed by pumping sand slurry down the tubing string 42, out the lower crossover ports 170, into the lower well annulus 60. As will be understood by those skilled in the art, the sand from the slurry will build up in the lower well annulus 60 around the screen assembly 50 and clean fluid from the slurry will enter the screen assembly 50 and flow up the wash pipe 64, then through the upper crossover ports 190 and up through the annular flow space 164 and ultimately out the upper crossover outlet 192 and then up through the upper well annulus 58.

After the lower well annulus 60 is gravel packed, the tubing string 42, and the crossover setting tool 48 with its wash pipe 64 are pulled completely out of the well 10 thus leaving the permanent production packer 46 and the screen assembly 50 and outer seal assembly 72 in place within the well 10.

Thus it is seen that the apparatus and methods of the present invention readily achieve the ends and advantages mentioned as well as those inherent therein. While certain preferred embodiments of the invention have been illustrated and described for purposes of the present disclosure, numerous changes may be made by those skilled in the art which changes are encompassed within the scope and spirit of the present invention as defined by the appended claims.

What is claimed is:

1. A gravel packing assembly constructed to be run on a tubing string into a well having a sump packer with a sump packer bore therethrough, said well having a well bore and a well annulus defined between said tubing string and said well bore, comprising:

an upper packer means for sealing between said tubing string and said well bore to divide said well annulus into an upper well annulus and a lower well annulus above and below said upper packer means, respectively;

a crossover setting tool, operably associated with said upper packer means, including crossover valve means for permitting reverse circulation of fluid up through said tubing string during running in of said tubing string and said gravel packing assembly into said well, said setting tool also including a downward extending wash pipe initially communicated with said tubing string;

a screen located below said upper packer means and having said wash pipe extending downwardly therethrough; and a wash pipe extension means, located below said screen, for permitting reverse circulation of sand fill out of said sump packer bore up through said wash pipe and said tubing string.

2. The gravel packing assembly of claim 1, wherein: said crossover valve means of said setting tool is further characterized as a means for subsequently isolating said wash pipe from said tubing string and communicating said wash pipe with said upper well annulus and said tubing string with said lower well annulus to permit gravel packing of said lower well annulus.

3. The gravel packing assembly of claim 1, wherein said wash pipe extension means comprises:

an outer seal assembly constructed to be received in said sump packer bore, said seal assembly having a seal assembly bore defined therethrough, said seal assembly bore having an upper end and a lower end, said wash pipe of said setting tool extending down into said upper end of said seal assembly bore;

a wash pipe extension partially received in said lower end of said seal assembly bore and extending downward below said seal assembly, said wash pipe extension being communicated with said wash pipe; and releasable retaining means, operably associated with said wash pipe and said wash pipe extension, for initially retaining said wash pipe extension in said seal assembly bore, and for subsequently releasing said wash pipe extension in response to upward movement of said wash pipe relative to said seal assembly.

4. The gravel packing assembly of claim 3, said sump packer bore having a sump packer bore length and a sump packer bore inner diameter, wherein:

said wash pipe extension extends below said seal assembly a distance greater than said sump packer bore length, and said wash pipe extension has an outside diameter less than said sump packer bore inner diameter, so that during reversing out of sand fill from said sump packer fluid can flow down between said sump packer bore and said wash pipe extension, then up into a lower end of said wash pipe extension to wash said sand fill out of said sump packer bore throughout said length of said sump packer bore.

5. The gravel packing assembly cf claim 3, wherein:

said releasable retaining means is further characterized as a means for allowing said wash pipe extension to drop out of said seal assembly bore when said wash pipe extension is released.

6. The gravel packing assembly of claim 3, wherein said releasable retaining means comprises:

a radially inwardly biased first spring collet defined on an upper end of said wash pipe extension, said first spring collet including a plurality of spring fingers each having a radially outwardly extending shoulder defined thereon;

an upwardly facing latching surface defined on said seal assembly bore; and support means for initially retaining said shoulders of said first spring collet in engagement with said latching surface of said seal assembly bore.

7. The gravel packing assembly of claim 6, wherein:

said support means is a support sleeve slidably disposed within said seal assembly bore, said support sleeve including a sleeve bore in which a lower end portion of said wash pipe is received, said support sleeve having a lower sleeve portion initially concentrically disposed within said first spring collet.

8. The gravel packing assembly of claim 7, wherein:

said lower end portion of said wash pipe has a lateral port disposed therethrough; and said gravel packing assembly further comprises seal means, disposed between said lower end portion of said wash pipe and said sleeve bore, for initially preventing flow through said lateral port until said wash pipe is moved upward relative to said seal assembly.

9. The gravel packing assembly of claim 7, further comprising:

second release means for releasing said support sleeve from said wash pipe after said wash pipe extension is released from said seal assembly, and for permitting said support sleeve to also drop out of said seal assembly bore.

10. The gravel packing assembly cf claim 9, wherein:

said second release means includes a second spring collet defined on said lower end portion of said wash pipe, said second spring collet having enlarged heads initially latching under a lower end of said support sleeve, said second spring collet being constructed to collapse and pull through said support sleeve.

11. The gravel packing assembly of claim 1, wherein:

said upper packer means is a permanent production packer means constructed to be left in place in said well with said screen after said lower well annulus is gravel packed.

12. A wash pipe extension apparatus for use in gravel packing a zone of a well above a sump packer having a sump packer bore therethrough, comprising:

an outer seal assembly, including seal means for sealing within said sump packer bore, said seal assembly having a seal assembly bore defined therethrough, said seal assembly bore having an upper end and a lower end;

a wash pipe having a lower end portion extending down into said upper end of said seal assembly bore;

a wash pipe extension partially received in said lower end of said seal assembly bore and extending downward below said seal assembly, said wash pipe extension being communicated with said wash pipe; and releasable retaining means, operably associated with said wash pipe and said wash pipe extension, for releasably retaining said wash pipe extension in said seal assembly bore.

13. The apparatus of claim 12, said sump packer bore having a sump packer bore length and a sump packer bore inner diameter, wherein:

said wash pipe extension extends below said seal assembly a distance greater than said sump packer bore length, and said wash pipe extension has an outside diameter substantially less than said sump packer bore inner diameter.

14. The apparatus of claim 12, wherein:

said releasable retaining means is further characterized as a means for allowing said wash pipe extension to drop out of said seal assembly bore when said wash pipe extension is released.

15. The apparatus of claim 12, wherein said releasable retaining means comprises:

a radially inwardly biased first spring collet defined on an upper end of said wash pipe extension, said first spring collet including a plurality of spring fingers each having a radially outwardly extending shoulder defined thereon;

an upwardly facing latching surface defined on said seal assembly bore; and support means for initially retaining said shoulders of said first spring collet in engagement with said latching surface of said seal assembly bore.

16. The apparatus of claim 15, wherein:

said support means is a support sleeve slidably disposed within said seal assembly bore, said support sleeve including a sleeve bore in which said lower end portion of said wash pipe is received, said support sleeve having a lower sleeve portion initially concentrically disposed within said first spring collet.

17. The apparatus of claim 16, further comprising:

interconnection means, between said support sleeve and said wash pipe, for moving said support sleeve upward with said wash pipe when said wash pipe is moved upward relative to said seal assembly.

18. The apparatus of claim 17, further comprising:

second release means for releasing said support sleeve from said wash pipe after said wash pipe extension is released from said seal assembly, and for permitting said support sleeve to also drop out of said seal assembly bore.

19. The apparatus of claim 18, wherein said second release means comprises:

a limit means, defined in said seal assembly bore above said support sleeve, for limiting upward movement of said support sleeve within said seal assembly bore; and a second spring collet defined on said lower end portion of said wash pipe, said second spring collet having enlarged heads initially latching under a lower end of said support sleeve to provide said interconnection means, said second spring collet being constructed to collapse and pull through said support sleeve upon engagement of said support sleeve with said limit means.

20. A method Of gravel packing a well comprising the steps of:

(a) supporting from a tubing string a gravel packing assembly including a permanent production packer, a screen located below said packer, and a setting tool associated with said packer and having a wash pipe extending down through said screen;

(b) running said tubing string and said gravel packing assembly into said well until a sand fill is encountered;

(c) reverse washing said sand fill up through said wash pipe and said tubing string;

(d) running said tubing string and said gravel packing assembly further into said well until said gravel packing assembly is located at a selected location in said well;

(e) setting said permanent production packer within said well to define an upper well annulus and a lower well annulus;

(f) communicating said tubing string with said lower well annulus and said wash pipe with said upper well annulus;

(g) raising said wash pipe relative to said screen with said permanent production packer and said screen fixed in place in said well to communicate said wash pipe with an interior of said screen;

(h) gravel packing said lower annulus of said well around said screen; and (i) removing said tubing string and said setting tool from said well leaving said permanent production packer and said screen in place in said well.

21. The method of claim 20, being further characterized as a method of gravel packing a zone of said well above a sump packer having a sump packer bore therethrough, wherein:

said step (a) is further characterized in that said gravel packing assembly includes a wash pipe extension assembly located below said screen;

said step (b) is further characterized in that said fill is encountered in said sump packer bore;

said step (c) is further characterized as reverse washing said sand fill out of said sump packer bore; and said step (d) is further characterized as running said tubing string and gravel packing assembly into said well until said wash pipe extension assembly is sealingly received in said sump packer bore.

22. A method of gravel packing a zone of a well above a sump packer having a sump packer bore therethrough comprising the steps of:

(a) supporting from a tubing string a gravel packing assembly including an upper packer, a screen located below said upper packer, a setting tool associated with said upper packer and having a wash pipe extending down through said screen, and a wash pipe extension assembly located below said screen;

(b) running said tubing string and said gravel packing assembly into said well until a sand fill is encountered in said sump packer bore;

reverse washing said sand fill out of said sump packer bore up through said wash pipe and said tubing string;

(d) running said tubing string and said gravel packing assembly further into said well until said gravel packing assembly is sealingly received in said sump packer bore;

(e) setting said upper packer within said well to define an upper well annulus and a lower well annulus;

(f) communicating said tubing string with said lower well annulus and said wash pipe with said upper well annulus;

(g) raising said wash pipe relative to said screen to communicate said wash pipe with an interior of said screen; and (h) gravel packing said lower annulus of said well around said screen.

* * * * *